US010195729B2

(12) United States Patent
Chien et al.

(10) Patent No.: US 10,195,729 B2
(45) Date of Patent: Feb. 5, 2019

(54) DRIVING DEVICE

(71) Applicant: Basso Industry Corp., Taichung (TW)

(72) Inventors: Chia-Yu Chien, Taichung (TW); Jian-Rung Wu, Taichung (TW)

(73) Assignee: Basso Industry Corp., Taichung (TW)

( * ) Notice: Subject to any disclaimer, the term of this patent is extended or adjusted under 35 U.S.C. 154(b) by 313 days.

(21) Appl. No.: 15/289,270

(22) Filed: Oct. 10, 2016

(65) Prior Publication Data

US 2017/0100828 A1 Apr. 13, 2017

(30) Foreign Application Priority Data

Oct. 12, 2015 (TW) ..... 104133399 A

(51) Int. Cl.

| | |
|---|---|
| ***B25C 1/06*** | (2006.01) |
| ***B25C 1/08*** | (2006.01) |
| *B25C 5/15* | (2006.01) |
| *B25C 1/00* | (2006.01) |

(52) U.S. Cl.

CPC ..... *B25C 1/06* (2013.01); *B25C 1/08* (2013.01); *B25C 1/00* (2013.01); *B25C 5/15* (2013.01)

(58) Field of Classification Search

CPC .... B25C 1/00; B25C 1/06; B25C 1/08; B25C 1/008; B25C 5/15

USPC ... 227/8, 129, 131, 132, 133, 138, 156, 120; 173/122, 114, 124, 205, 117

See application file for complete search history.

(56) References Cited

U.S. PATENT DOCUMENTS

| | | | | |
|---|---|---|---|---|
| 6,669,072 | B2 * | 12/2003 | Burke | B25C 1/06 173/122 |
| 6,971,567 | B1 * | 12/2005 | Cannaliato | B25C 1/06 173/1 |
| 7,334,715 | B2 * | 2/2008 | Oda | B25C 1/06 173/178 |
| 7,506,788 | B2 * | 3/2009 | Liang | B25C 1/06 227/129 |
| 7,575,141 | B1 * | 8/2009 | Liang | B25C 1/06 173/124 |

(Continued)

FOREIGN PATENT DOCUMENTS

| | | |
|---|---|---|
| DE | 4040508 A1 | 6/1991 |
| EP | 2431131 A2 | 3/2012 |

(Continued)

OTHER PUBLICATIONS

EP search report in corresponding EP application No. 16193304.9-1701/3156182 dated Mar. 29, 2017 (5 pages).

*Primary Examiner* — Scott A. Smith

(74) *Attorney, Agent, or Firm* — Trop Pruner & Hu, P.C.

(57) ABSTRACT

A driving device is adapted for use in an electric nail gun. The electric nail gun includes a supporting frame. The driving device includes a swing arm unit, a control unit and a driving unit. The swing arm unit is swingable between a standby position and a shooting position. The control unit includes a control member having a driven end portion, and an abutting end portion opposite to the driven end portion. The driving unit is for driving the driven end portion of the control member to rotate between a driving position and a non-driving position, and includes a control-member biasing resilient member disposed between the driven end portion of the control member and the supporting frame.

9 Claims, 5 Drawing Sheets

(56) References Cited

U.S. PATENT DOCUMENTS 8,210,409 B2 * 7/2012 Hirabayashi ..... B25C 1/06 227/131
8,302,833 B2 * 11/2012 Gross ..... B25C 1/06 227/133
8,479,966 B2 * 7/2013 Chien ..... B25F 5/006 173/124
8,511,532 B2 * 8/2013 Chien ..... B25C 1/06 227/120
8,740,033 B2 * 6/2014 Li ..... B25C 1/06 227/131
8,991,675 B2 * 3/2015 Liang ..... B25C 1/06 227/129
9,216,502 B2 * 12/2015 Brendel ..... B25C 1/06
9,399,281 B2 * 7/2016 Brendel ..... B25C 1/06
9,744,657 B2 * 8/2017 Baron ..... B25C 5/15
2005/0218178 A1 10/2005 Berry
2009/0250500 A1 * 10/2009 Brendel ..... B25C 1/06 227/132
2009/0294505 A1 * 12/2009 Kunz ..... B25C 1/06 227/8
2010/0038397 A1 * 2/2010 Krondorfer ..... B25C 1/06 227/8
2011/0259937 A1 * 10/2011 Chien ..... B25C 1/06 227/120
2013/0153254 A1 * 6/2013 Liang ..... B25D 11/00 173/114
2013/0255984 A1 * 10/2013 Po ..... B25C 1/06 173/112
2014/0097223 A1 * 4/2014 Baron ..... B25C 5/15 227/131
2015/0251300 A1 * 9/2015 Po ..... B25C 1/06 227/132

FOREIGN PATENT DOCUMENTS

EP 2644323 A2 10/2013
EP 2716409 A2 4/2014
TW I422470 1/2014

* cited by examiner

DRIVING DEVICE

CROSS-REFERENCE TO RELATED APPLICATION

This application claims priority of Taiwanese Patent Application No. 104133399, filed on Oct. 12, 2015.

FIELD

The disclosure relates to a driving device, and more particularly to a driving device of an electric nail gun.

BACKGROUND

As shown in FIG. 1, a conventional electric nail gun 1 disclosed in Taiwanese Patent No. 1422470 includes a supporting frame 10, a nail passage 11 formed at a front end portion of the supporting frame 10 and for receiving a nail 21, a trigger unit 12 pivotally mounted to the supporting frame 10 and controllable by a control circuit to trigger a nail striking operation, a transmission unit 13, an impact unit 14 and a driving unit 15. The transmission unit 13 includes a flywheel 131 pivotally mounted to the supporting frame 10, and a motor 132 mounted to the supporting frame 10 and driving a high speed rotation of the flywheel 131. The impact unit 14 includes a swing arm 141 pivotally mounted to the supporting frame 10 and rotatable relative to the flywheel 131, and an impact member 142 slidable relative to the swing arm 141. The driving unit 15 includes a solenoid valve 151 mounted to the supporting frame 10, a slant push block 152 abutting against one end of the swing arm 141, and a connecting rod 153 pivotally mounted to the supporting frame 10.

Normally, the impact member 142 is spaced apart from the flywheel 131 at a distance that is 0.5 millimeters. During operation, when the trigger unit 12 is triggered, the solenoid valve 151 drives the connecting rod 153 to push the slant push block 152 to thereby move the slant push block 152 the swing arm 141 toward the flywheel 131 so that, the impact member 142 comes into contact with the flywheel 131 and then is thrown to strike the nail 21 to complete the nail striking operation.

However, since the slant push block 152 is biased to press against an upper end of the connecting rod 153, a resistance is created to impede activation of the solenoid valve 153, thereby adversely affecting smooth nail striking operation.

SUMMARY

Therefore, the object of the disclosure is to provide a driving device that can drive smooth operation of an electric nail gun.

According to the disclosure, the driving device is adapted for use in an electric nail gun. The electric nail gun includes a supporting frame, a rotatable flywheel pivotally mounted to the supporting frame, and an impact member. The driving device includes a swim arm unit, a control unit and a driving unit. The swing arm unit is pivotally mounted to the supporting frame, includes an abutment surface, is adapted to permit the impact member to be movably mounted thereto, and is swingable between a standby position and a shooting position such that, when the swing arm unit is at the standby position, the impact member is spaced apart from the flywheel, and when the swing arm unit is at the shooting position, the impact member is in contact with the flywheel. The control unit includes a control member having a driven end portion, and an abutting end portion that is opposite to the driven end portion and that slidably abuts against the abutment surface of the swing arm unit. The driving unit is for driving the driven end portion of the control member to rotate between a driving position and a non-driving position such that, when the driven end portion of the control member is at the driving position, the swing arm unit is at the shooting position, and when the driven end portion of the control member is at the non-driving position, the swing arm unit is at the standby position. The driving unit includes a main body, and a valve rod movable relative to the main body for rotating the driven end portion of the control member between the driving position and the non-driving position. The driving unit further includes a control-member biasing resilient member disposed between the driven end portion of the control member and the supporting frame for providing a resilient force to push the driven end portion of the control member to abut against the valve rod so as to maintain the driven end portion of the control member at the non-driving position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
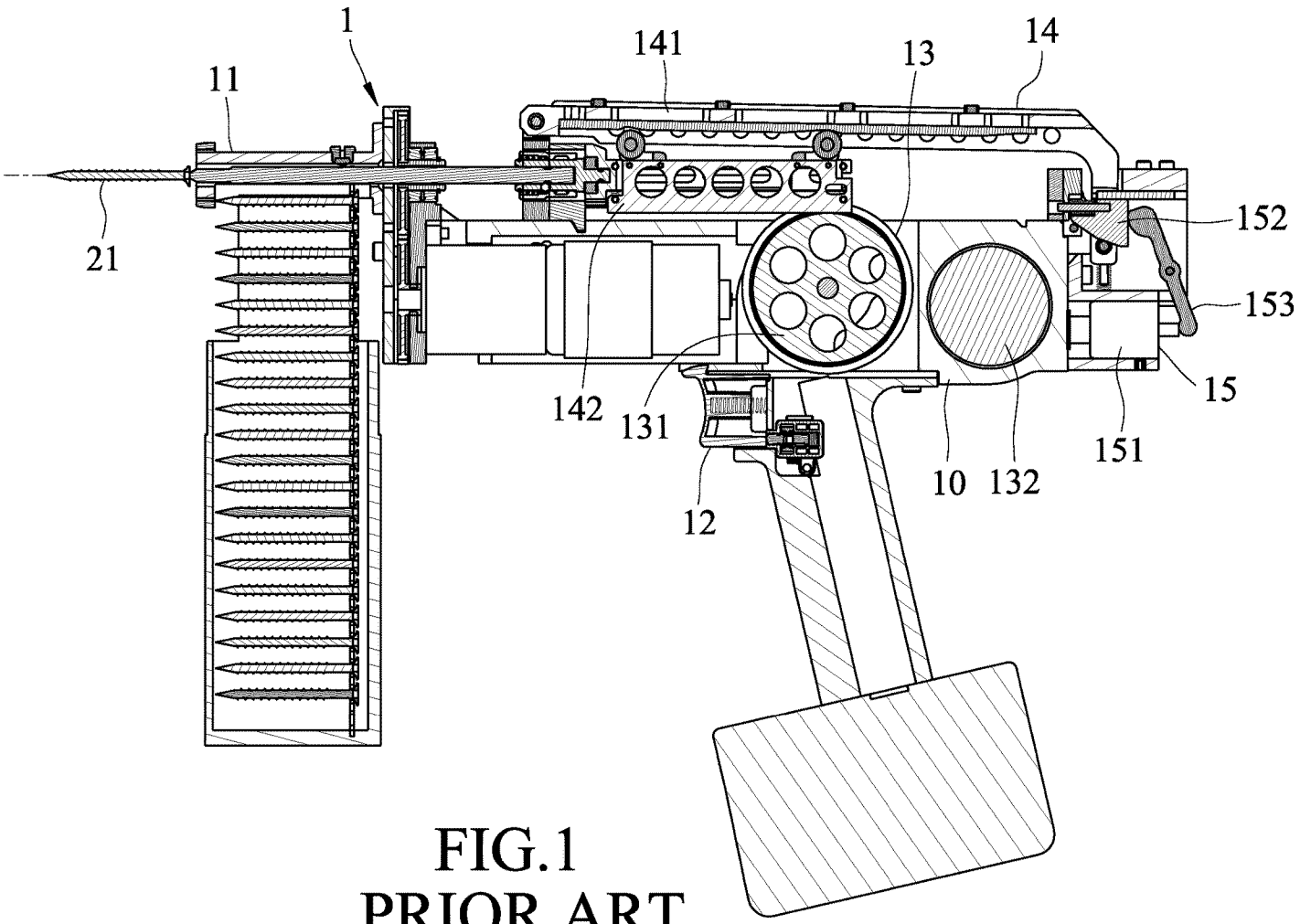
FIG.1 PRIOR ART
FIG. 1 is a sectional view of Taiwanese Patent Number No. I422470.
Figure 2:
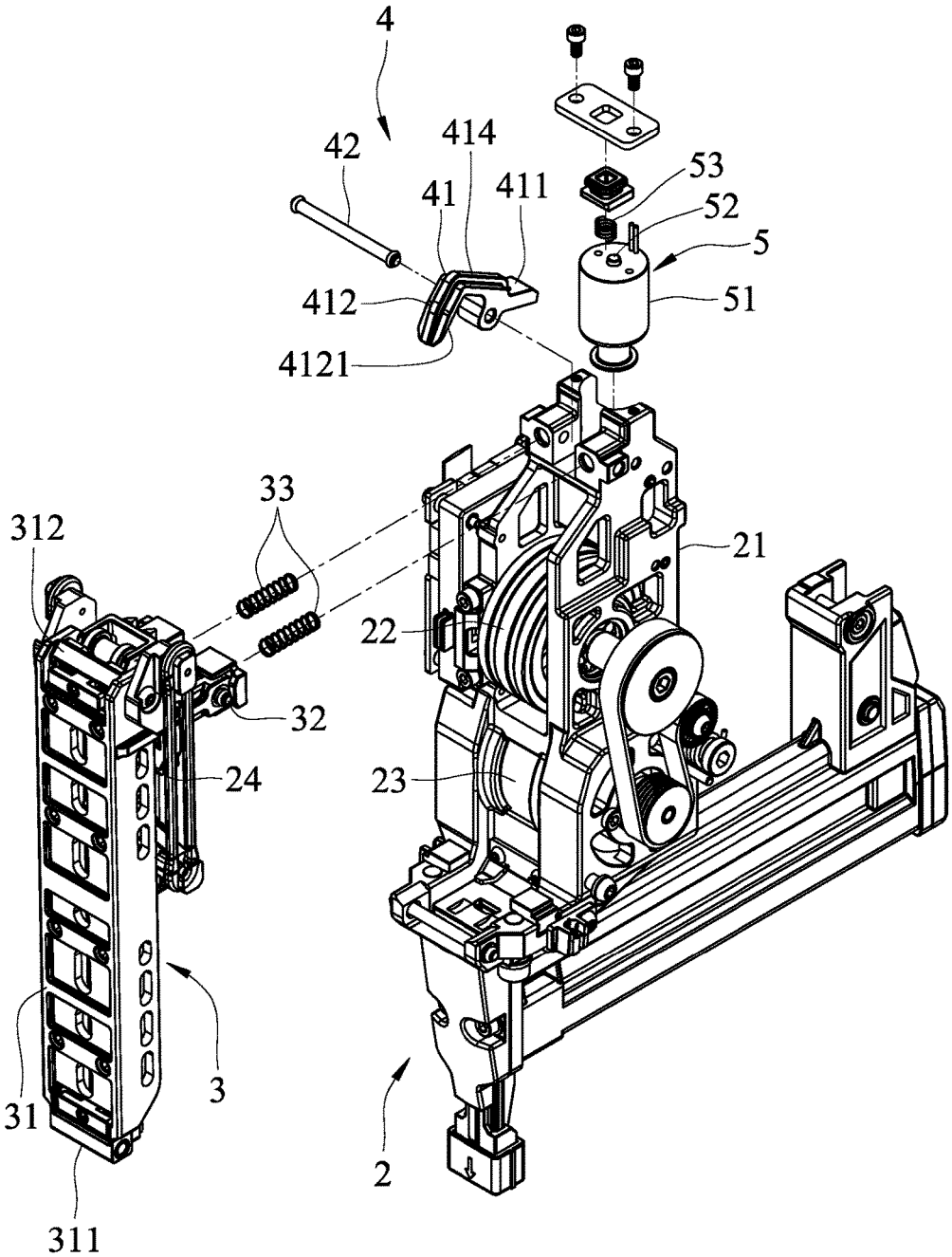
FIG. 2 is an exploded perspective view of an embodiment of a driving device of an electric nail gun according to the disclosure.
Figure 3:
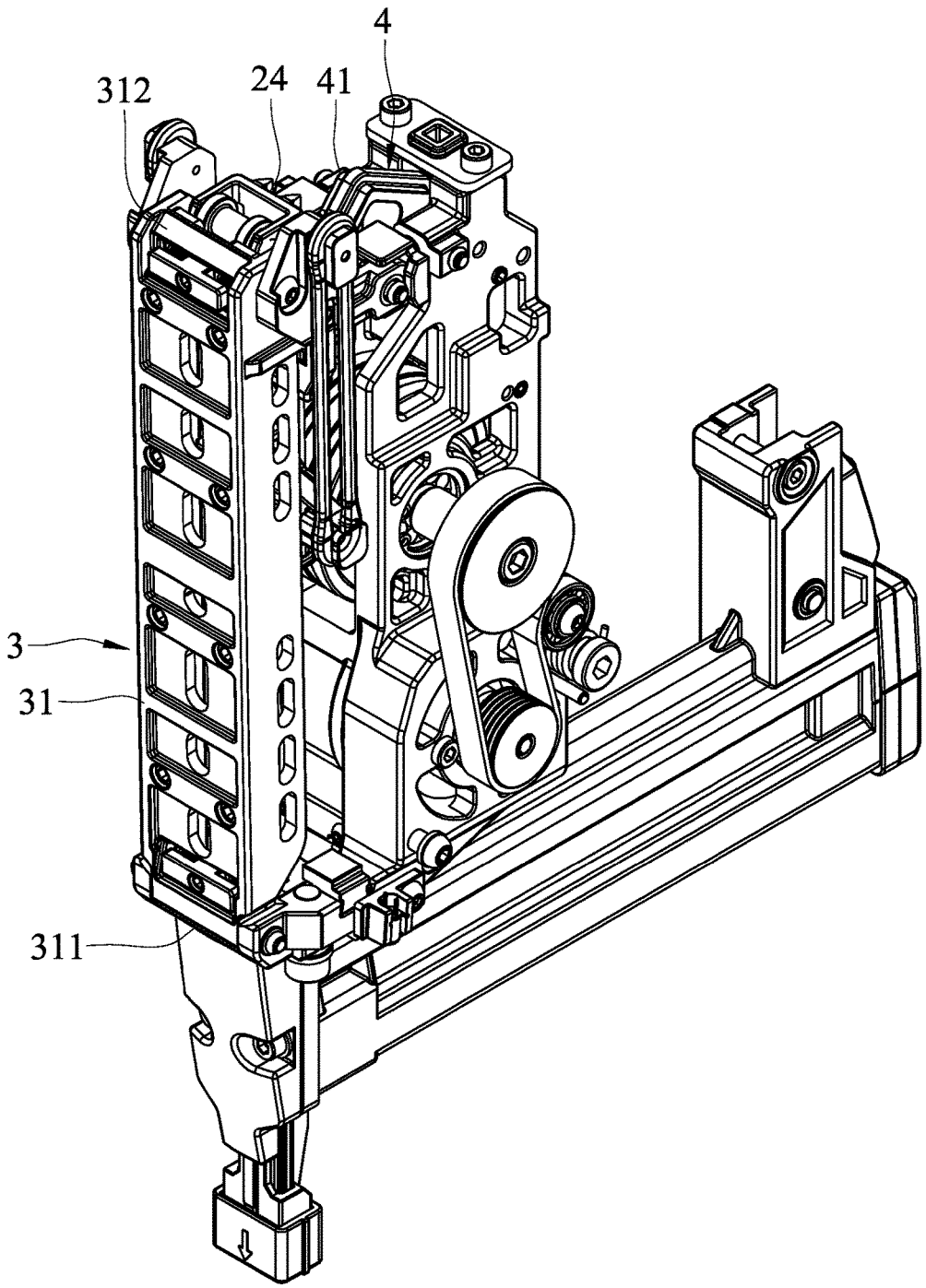
FIG. 3 is perspective view of the electric nail gun.

Referring to FIGS. 2 to 5, the embodiment of a driving device is adapted for use in an electric nail gun 2. The electric nail gun 2 includes a supporting frame 21, a rotatable flywheel 22 pivotally mounted to the supporting frame 21, a motor 23 mounted to the supporting frame 21 and driving a high speed rotation of the flywheel 22, and an impact member 24 movable relative to the flywheel 22. The driving device includes a swing arm unit 3, a control unit 4 and a driving unit 5.

The swing arm unit 3 includes a swing arm 31, a rod member 32 and two swing-arm biasing resilient members 33. The swing arm 31 is pivotally mounted to the supporting frame 21 and adapted to permit the impact member 24 to be movably mounted thereto, and has a pivot end 311 pivotally connected to the supporting frame 21, and a swinging end 312. The swing arm unit 3 is swingable between a standby position (see FIG. 4) and a shooting position (see FIG. 5) such that, when the swing arm unit 3 is at the standby position, the impact member 24 is spaced apart from the flywheel 22, and when the swing arm unit 3 is at the shooting position, the impact member 24 is in contact with the flywheel 22. The rod member 32 is fixedly received within the swinging end 312 of the swing arm 31, and is formed with an abutment surface 321. The swing-arm biasing resilient members 33 are disposed between the supporting frame 21 and the swinging end 312 of the swing arm 31 for biasing the swing arm unit 3 toward the standby position.

The control unit 4 includes a control member 41 and a pivot pin 42. The control member 41 has a driven end portion 411, and an abutting end portion 412 opposite to the driven end portion 411 and slidably abutting against the abutment surface 321 of the swing arm unit 3. The control member 41 is pivotally mounted to the supporting frame 21 at a portion of the control member 41 which is disposed between the driven end portion 411 and the abutting end portion 412. The abutting end portion 412 of the control member 41 has an abutting surface 4121 abutting against the abutment surface 321 of the rod member 32. The control member 41 further has a connecting portion 414 connected between the abutting end portion 412 and the portion of the control member 41 which is disposed between the driven end portion 411 and the abutting end portion 412, and being not parallel to an extending line of the abutting surface 4121 of the abutting end portion 412. The pivot pin 42 connects rotatably the control member 41 to the supporting frame 21. An angle (θ) is formed between the extending line of the abutting surface 4121 and a straight connecting line which extends through centers of the rod member 32 of the swing arm unit 3 and the pivot pin 42 of the control unit 4.

The driving unit 5 is mounted to the supporting frame 21, and is for driving the driven end portion 411 of the control member 41 to rotate between a driving position (see FIG. 5) and a non-driving position (see FIG. 4) such that, when the driven end portion 411 of the control member 41 is at the driving position, the swing arm unit 3 is at the shooting position, and when the driven end portion 411 of the control member 41 is at the non-driving position, the swing arm unit 3 is at the standby position. The driving unit 5 includes a main body 51, a valve rod 52 movable relative to the main body 51 for rotating the driven end portion 411 of the control member 41 between the driving position and the non-driving position, and a control-member biasing resilient member 53. The control-member biasing resilient member 53 is disposed between the driven end portion 411 of the control member 41 and the supporting frame 21, and is for providing a resilient force to push the driven end portion 411 of the control member 41 to abut against the valve rod 52 so as to maintain the driven end portion 411 of the control member 41 at the non-driving position. In this embodiment, the driving unit 5 is a solenoid valve.

It should be noted that, when the driven end portion 411 of the control member 41 is at the driving position, the angle (θ) is ranged between 85 to 95 degrees. Preferably, the angle (θ) is ranged between 88 to 92 degrees, and the optimum angle (θ) is 90 degrees.

Figure 4:
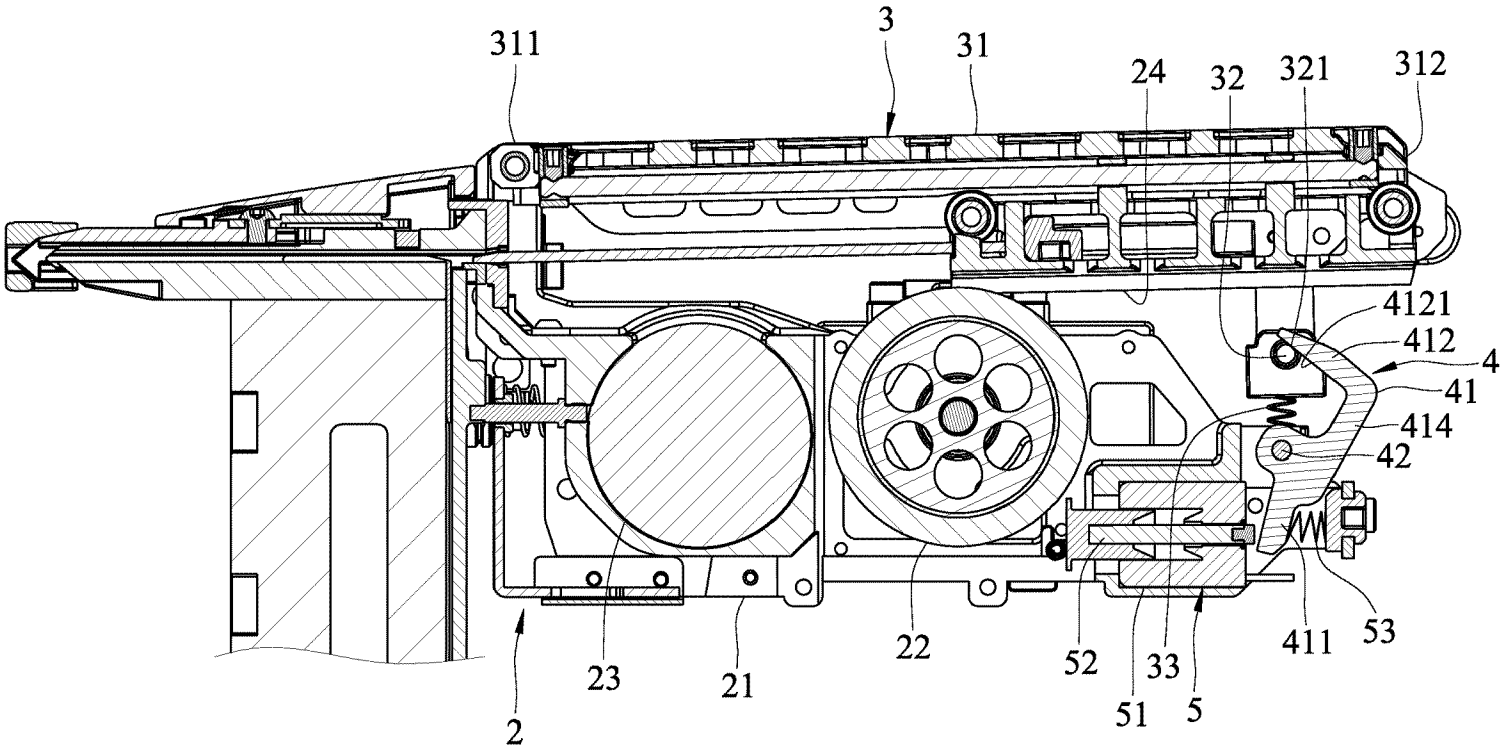
FIG. 4 is a sectional view of the electric nail gun when a swim arm unit is at a standby position and a driven end portion of a control member is at a non-driving position.

As shown in FIG. 4, when the electric nail gun 2 is not triggered, since the valve rod 52 of the driving unit 5 is not applied with an electric current, no push force is applied by the abutting end portion 412 of the control member 41 to the rod member 32, thereby allowing the swing arm unit 3 to be biased by the swing-arm biasing resilient members 33 to the standby position.

Figure 5:
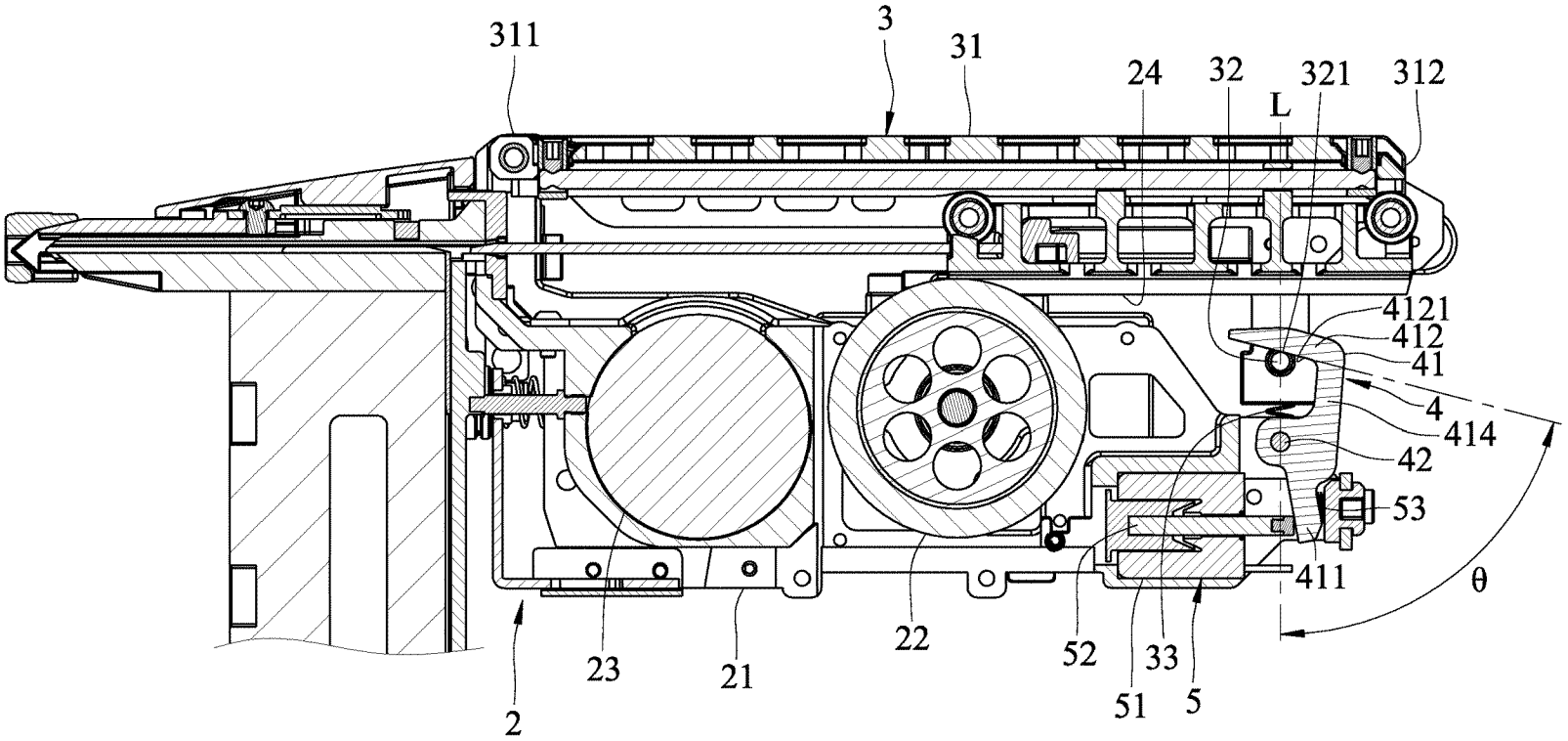
FIG. 5 is a sectional view of the electric nail gun when the swim arm unit is at a shooting position and the driven end portion of the control member is at a driving position.

As shown in FIG. 5, after the electric current is applied, the valve rod 52 of the driving unit 5 rotates the driven end portion 411 of the control member 41 to the driving position. At this moment, the abutting end portion 412 of the control member 41 pushes the abutment surface 321 of the rod member 32 to overcome a resilient force provided by the swing-arm biasing resilient members 33. Hence, the swing arm unit 3 is swung toward the shooting position until and the impact member 24 comes into contact with the flywheel 22. As a result, the impact member 24 is thrown by the flywheel 22 to complete a nail striking operation.

With the abovementioned configuration, the driving device of the disclosure has the following advantages:

1. The disclosure can use only one component (i.e., the control member 41) to drive the swing arm 31, the structure of the electric nail gun 2 is simplified.

2. With above-mentioned structure, the stability and the fluency of the nail striking operation are improved.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment", "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A driving device adapted for use in an electric nail gun, the electric nail gun including a supporting frame, a rotatable flywheel that is pivotally mounted to the supporting frame, and an impact member, said driving device comprising:

a swing arm unit pivotally mounted to the supporting frame, including an abutment surface, adapted to permit the impact member to be movably mounted thereto, and swingable between a standby position and a shooting position such that, when said swing arm unit is at the standby position, the impact member is spaced apart from the flywheel, and when said swing arm unit is at the shooting position, the impact member is in contact with the flywheel;

a control unit including a control member that has a driven end portion, and an abutting end portion opposite to said driven end portion and slidably abutting against said abutment surface of said swing arm unit; and a driving unit for driving said driven end portion of said control member to rotate between a driving position and a non-driving position such that, when said driven end portion of said control member is at the driving position, said swing arm unit is at the shooting position, and when said driven end portion of said control member is at the non-driving position, said swing arm unit is at the standby position;

wherein said driving unit includes a main body, and a valve rod movable relative to said main body for rotating said driven end portion of said control member between the driving position and the non-driving position; and wherein said driving unit further includes a control-member biasing resilient member disposed between said driven end portion of said control member and the supporting frame, for providing a resilient force to push said driven end portion of said control member to abut against said valve rod so as to maintain said driven end portion of said control member at the non-driving position.

2. The driving device as claimed in claim 1, wherein said control member is pivotally mounted to the supporting frame at a portion of said control member which is disposed between said driven end portion and said abutting end portion.

3. The driving device as claimed in claim 2, wherein said control unit further includes a pivot pin connecting rotatably said control member to the supporting frame.

4. The driving device as claimed in claim 3, wherein:

said swing arm unit includes a swing arm and a rod member;

said swing arm has a pivot end pivotally connected to the supporting frame, and a swinging end;

said rod member is fixedly received within said swinging end of said swing arm, and is formed with said abutment surface; and said abutting end portion of said control member has an abutting surface abutting against said abutment surface of said rod member such that, when said driven end portion of said control member is at the driving position, an angle is formed between an extending line of said abutting surface and a straight connecting line which extends through centers of said rod member of said swing arm unit and said pivot pin of said control unit.

5. The driving device as claimed in claim 4, wherein said swing arm unit further includes a swing-arm biasing resilient member disposed between the supporting frame and said swing arm for biasing said swing arm unit toward the standby position.

6. The driving device as claimed in claim 4, wherein the angle is ranged between 85 to 95 degrees.

7. The driving device as claimed in claim 6, wherein the angle is ranged between 88 to 92 degrees.

8. The driving device as claimed in claim 4, wherein said control member further has a connecting portion connected between said abutting end portion and the portion of said control member which is disposed between said driven end portion and said abutting end portion, and being not parallel to the extending line of said abutting surface of said abutting end portion.

9. The driving device as claimed in claim 1, wherein said driving unit is a solenoid valve.

* * * * *